US005772118A

United States Patent [19]

Fabiano

[11] Patent Number: 5,772,118

[45] Date of Patent: Jun. 30, 1998

[54] SPRINKLER HEAD SHIELD

[75] Inventor: Stephen F. Fabiano, Naples, Fla.

[73] Assignee: Valdemar Prince, Naples, Fla.

[21] Appl. No.: 593,144

[22] Filed: Feb. 1, 1996

[51] Int. Cl.[6] ..... B05B 15/06

[52] U.S. Cl. ..... 239/276; 239/288.5

[58] Field of Search ..... 239/288, 288.3, 239/288.5, 273, 276, 201, 204, 205, 200, 203, 206, 390, 391, 397, 436, 442

[56] References Cited

U.S. PATENT DOCUMENTS

| | | | |
|---|---|---|---|
| 1,837,322 | 12/1931 | Hamilton . | |
| 1,893,210 | 1/1933 | Rider | 239/201 |
| 2,909,326 | 10/1959 | Hruby, Jr. | 239/206 |
| 2,989,246 | 6/1961 | Sloane | 239/204 |
| 3,018,057 | 1/1962 | Anderson | 239/201 |
| 3,265,310 | 8/1966 | Cohen | 239/201 |
| 3,662,956 | 5/1972 | Hedman | 239/201 |
| 3,715,077 | 2/1973 | Grenier | 239/200 |
| 3,762,642 | 10/1973 | Di Santo | 239/201 |
| 3,904,120 | 9/1975 | Sbicca | 239/201 |
| 3,929,288 | 12/1975 | Brusadin et al. | 239/201 |
| 4,274,592 | 6/1981 | Westhusin | 239/200 |
| 4,393,992 | 7/1983 | Strunk et al. | 239/200 |
| 4,562,962 | 1/1986 | Hartman | 239/200 |
| 4,753,391 | 6/1988 | Rogers | 239/203 |
| 5,039,011 | 8/1991 | Parker | 239/1 |
| 5,137,307 | 8/1992 | Kinsey | 285/156 |
| 5,213,262 | 5/1993 | Violette | 239/203 |
| 5,265,803 | 11/1993 | Thayer | 239/71 |
| 5,372,306 | 12/1994 | Yianilos | 239/201 |

*Primary Examiner*—Lesley D. Morris
*Attorney, Agent, or Firm*—Oldham & Oldham Co., L.P.A.

[57] ABSTRACT

The improved sprinkler shield comprises a rigid body having a lip extending outward from the top portion of the body which lies on the ,round surface with the body embedded in the ground. Soil gripping vanes may be provided along the outside of the body. The base of the body includes an aperture disposed within providing an interface connection between sprinkler head and the water supply. A sprinkler head retention member, such as a retention disc, having an aperture therein is releasably mounted to the inside of the body near its top. The head retention member provides lateral support to sprinkler heads mounted in the body and through the retention disc. The retention disc may have a variably sized aperture enabling the shield to accommodate various sizes and configurations of sprinkler heads. The shield provides protection to sprinkler heads from lateral and downward impacts. The shield further facilitates preventing grass or vegetation from growing over a sprinkler head, resulting in proper operation of the head and allowing simple detection of damaged, obstructed or defective sprinkler heads.

20 Claims, 3 Drawing Sheets

SPRINKLER HEAD SHIELD

FIELD OF THE INVENTION

A variety of devices are available which have been designed to enclose or surround lawn sprinkler heads for their protection. Frequently sprinkler heads are damaged when stepped upon or struck with a lawnmower or the like. These prior shield devices are usually embedded in the soil surrounding the sides of the sprinkler head and are flush with the ground surface.

It should be recognized that an unprotected sprinkler head could easily be damaged from an impact by an external force, such as a lawnmower, vehicle or the like. Such an impact could result in the sprinkler head actually becoming damaged such that it does not operate correctly, or misalignment of the sprinkler head within the ,round. Although the prior art devices may be effective in protecting the sprinkler heads from direct side impacts, a direct downward impact may still damage the head. Many times, even if prior shield devices are used, the top of the sprinkler head may still be susceptible to damage to lawn maintenance equipment, as the top of the sprinkler head is substantially flush with the ground level and exposed at this level.

Another drawback to prior art devices which surround a sprinkler head has been found in the device not remaining stationary when implanted into the soil. In operation of a sprinkler system, the constant flushing of the sprinkler head seals can cause softening of the surrounding soil, such that the sprinkler head may have a tendency to twist, turn and sink into the soil. Particularly in soft soil, if the sprinkler head is driven over, hit or knocked, additional misalignment or damage of the sprinkler head may occur. Eventually, because the shield device is not stationary, its motion along with the motion of the sprinkler head can cause instability, can create undesired spray patterns or can damage the sprinkler head itself, or even more importantly, the underground water supply lines.

It has also been found with prior art devices, that the protective devices are designed specifically for a single type of sprinkler head, and are not adaptable to a variety of sprinkler heads which are commercially available. The prior art devices further do not generally provide support for a sprinkler head which will facilitate preventing damage or misalignment thereof It has also been found that such devices do not substantially prevent the lawn or turf from growing over the sprinkler head causing difficulty with operation of the typical pop-up sprinkler head, as well as in locating a damaged, obstructive or defective sprinkler head.

Further, most sprinkler systems currently use poly vinyl chloride (PVC) or other types of conduit to interconnect the sprinkler heads with the available water supply. If a sprinkler head is misaligned or damaged, and needs to be replaced, the process is very involved. To repair the sprinkler head requires excavation of the soil surrounding the sprinkler head and/or any protective device resulting in disassembling of the sprinkler head from the water supply conduit. Not only is this operation difficult and time consuming, the process may also destroy the established grass or garden areas and may disturb the soil compaction in the immediate vicinity of the sprinkler head. Furthermore, and very importantly, the repair process can allow dirt and debris to contaminate the water supply conduit, creating additional malfunctioning of the sprinkler system by clogging, or otherwise damaging components of the system. Accordingly, an improved sprinkler protection and interface to a sprinkler system water supply would be highly desirable.

SUMMARY OF THE INVENTION

The present invention provides an improved sprinkler shield comprising a rigid, self-supporting frusto-conical body, an arcuate lip extending outward from the top portion of the body, and soil gripping vanes extending downward from the top and along the outside of the body. The base of the body is preferably vaned internally and externally and includes a standard industry sprinkler head sized threaded aperture centrally disposed therein. The external soil gripping vanes may be positioned in spaced apart relationship at predetermined distances, and may extend downward from the outer edge of the arcuate lip to the outside of the frusto-conical body. A retention disc having a variable and adjustable aperture is releasably mounted on the inside of the body, and enables the retention disc to rest on a small seam or ledge, and provides lateral support to a sprinkler head mounted in the body of the shield and through the retention disc.

It is therefore one object of the invention to provide an improved shield device which provides protection to sprinkler heads from lateral and downward impacts.

A further object of the invention is to provide a sprinkler shield which prevents grass or vegetation from growing over a sprinkler head, facilitating proper operation of the head and allowing simple detection of damaged, obstructed or defective sprinkler heads.

Another object of the invention is to provide a sprinkler shield that once embedded in the soil, resists shifting or twisting, and maintains its original stationary position.

A further object of the invention is to provide a sprinkler shield which functions as an interface to a sprinkler system water supply, and allows for simple and inexpensive replacement of sprinkler heads without contamination of the sprinkler system water supply.

This along with other objects and advantages of the invention will become more readily apparent from a reading of the detailed description taken in conjunction with the drawings and claims.

DETAILED DESCRIPTION OF THE PREFERRED EMBODIMENT

Figure 1:
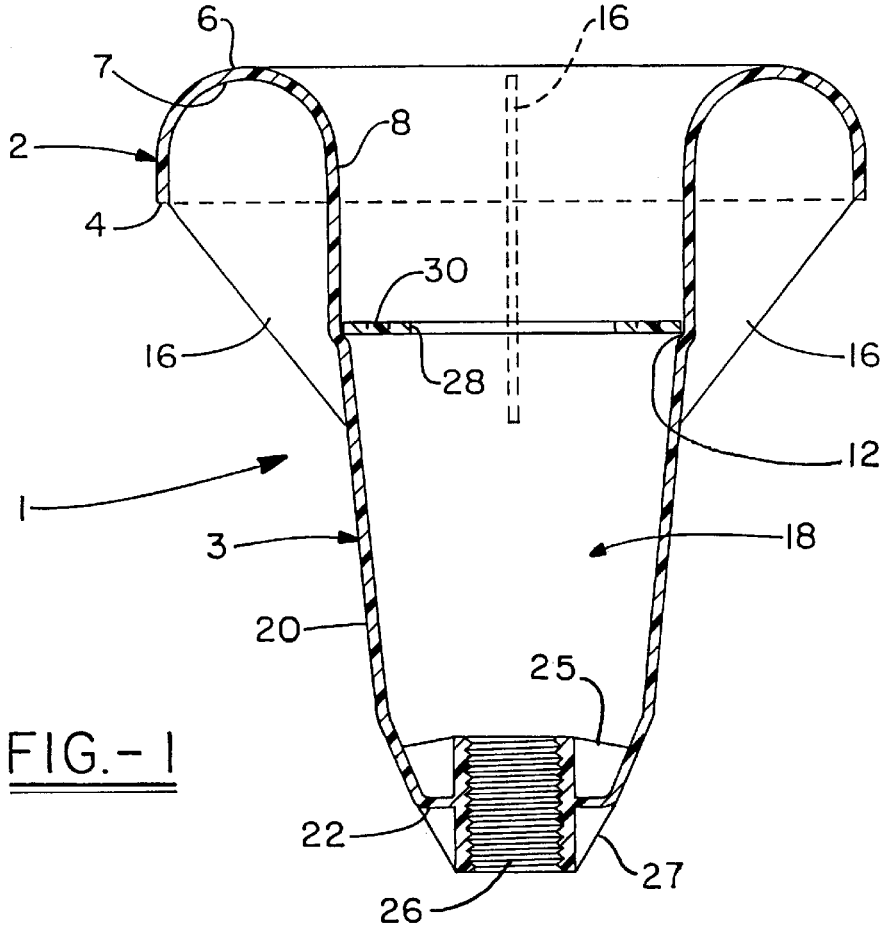
FIG. 1 is a front cross-sectional elevational view of the improved sprinkler head shield.

The preferred embodiment of the improved sprinkler head shield 1 is shown in FIGS. 1, 2, 5 and 6. In the preferred embodiment, sprinkler shield 1 is comprised of a rigid, self-supporting frusto-conical body 3, preferably fabricated from plastic, fiberglass, epoxy, carbon fiber, Kevlar or any other material. Preferably the shield 1 is fabricated of a material which is resistant to corrosion when disposed in the soil. The frusto-conical shape of body 3 is formed by side wall 20, base 22, and upstanding lip 2 which may all be continuous due to the circular configuration of body 3. Recess 18, formed within body 3, allows a sprinkler head to be entirely disposed within body 3. While body 3 is frusto-conical in the preferred embodiment, any shape such as tubular or rectangular is also suitable if it provides a cavity in which a sprinkler head can be disposed. The frusto-conical embodiment allows for easier installation in soil as it matches the natural shape which holes form when dug in soil. The preferred shape will also facilitate manufacture in a cost-effective manner. For example, the invention may be molded from plastic with the shape of the body chosen to simplify and reduce cost of molds and manufacturing. If the shape of body 3 is something other than circular or conical, body 3 will be made up of a plurality of side walls 20. An example would be a rectangular shaped body 3 which would require four side walls 20. In the preferred embodiment, the sprinkler shield 1, is molded as a continuous member, but could also be comprised of several pieces. For example, body 3 and upstanding lip 2 could be separate pieces that are coupled together by snap-fit, adhesives or other means known in the art. This would allow for different sized or shaped parts to be mixed and matched to accommodate the particular sprinkler system with which it is used.

Extending from the top of body 3 is upstanding lip 2 which may be formed to extend upwardly from inner edge 8, to maximum height at its center and downwardly to outer edge 4. Upstanding lip 2 may be arcuately shaped as an extension of side wall 20 and preferably forms a retention cavity 7 directly beneath it. Upstanding lip 2 is also contemplated as a separate component which could be attached to body 3 through means known in the art, such as adhesives or mechanical fasteners. This may allow various sizes or shapes to be used for different conditions to allow the device to be flexible to a particular environment. Lip 2 could also be rectangular or angular or any other desired shape. The lip 2 also extends upwardly from the ground surface 5 to form a barrier to the interior cavity of the body 3 where the sprinkler head 40 will be positioned. This will protect the sprinkler head 40 from side or lateral impacts from lawn maintenance equipment or the like. The opening in the body 3 to accommodate the sprinkler head 40 also is preferably dimensioned to limit the extent to which a foreign article, such as the wheel of lawn maintenance equipment, can extend downwardly into the cavity to protect the sprinkler head 40 from downward impacts.

Figure 5:
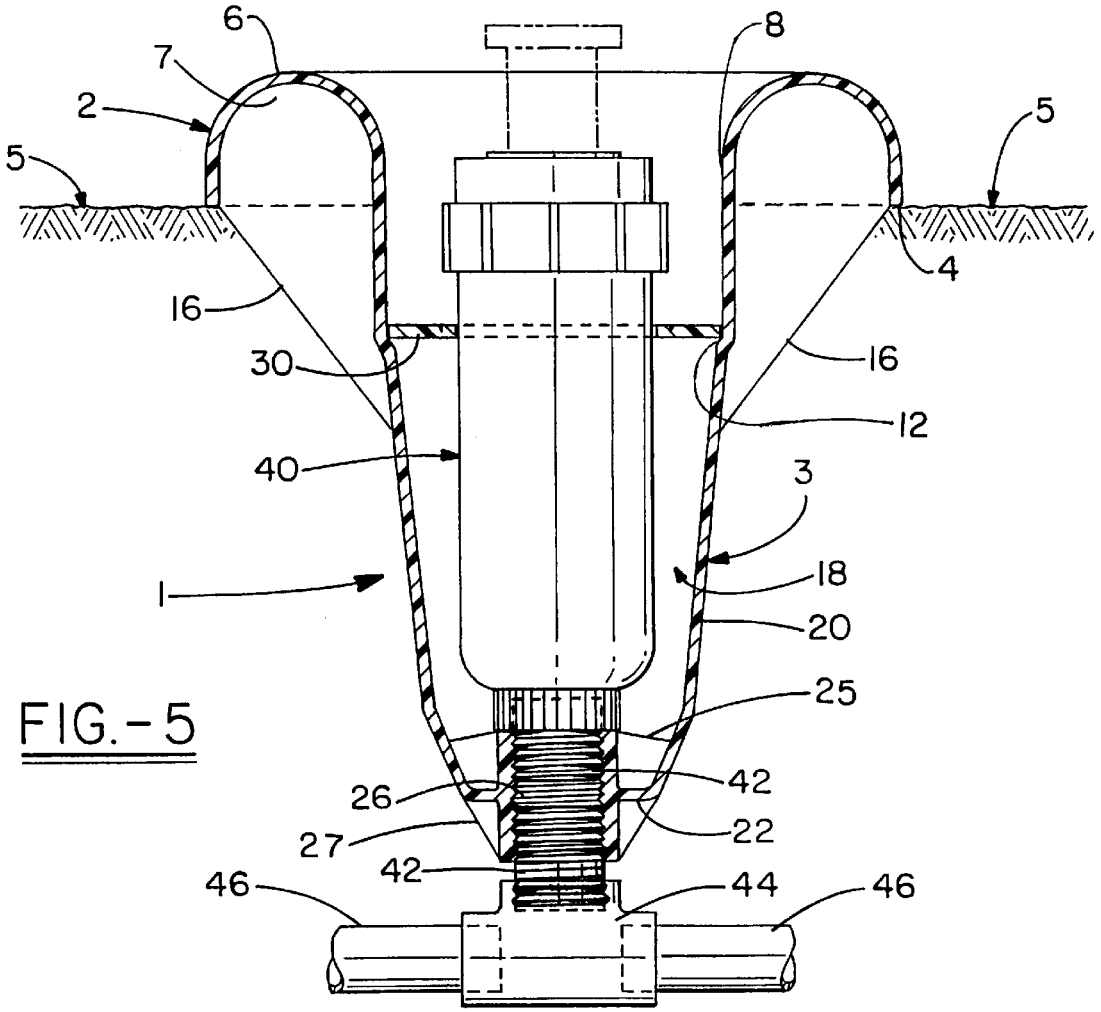
FIG. 5 is a partial front cross-sectional elevational view of the improved shield assembled with a typical pop-up type sprinkler head and water supply lines.
Figure 6:
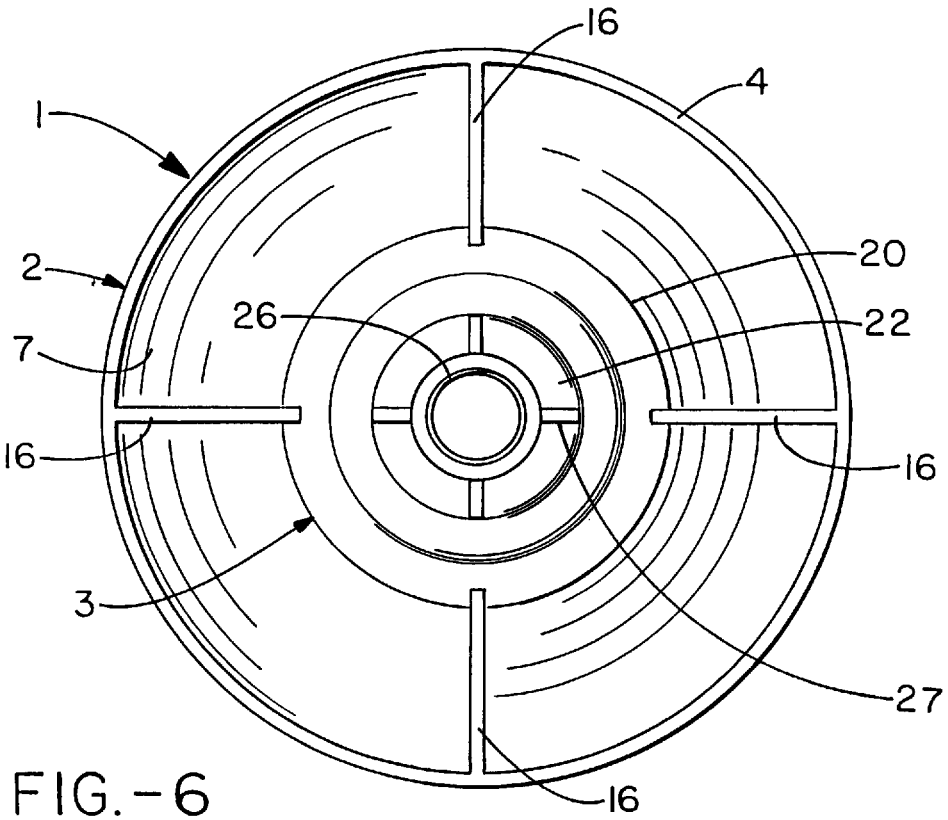
FIG. 6 is a bottom plan view of the improved shield.

Additionally, by forming lip 2 to extend upwardly, the wall thereof naturally forms a soil retention cavity 7 beneath it. When sprinkler shield 1, as shown in FIG. 5, is embedded in soil, retention cavity 7 can trap soil beneath it to further stabilize the unit. The lip 2 also provides downward retention preventing sprinkler shield 1 from being pushed further into the soil 5 than appropriate by extending outwardly from body 3. Without outwardly extending lip 2, sprinkler shield 1 could be pushed downward far enough to damage water supply connectors 42 and 44 and water supply lines 46. The lip 2 also inhibits the growth of grass or other vegetation over the cavity in which sprinkler head 40 is positioned. This allows damaged, obstructed or defective sprinkler heads to be detected much more easily. This also allows the sprinkler head 40 to function properly to produce a desired spray pattern for example, without vegetation obstructing the opening. For pop-up type sprinkler heads 40, preventing the growth of vegetation over the opening is essential for proper operation.

To further prevent damage to the water supply connector 42 and 44 and supply lines 46 a plurality of external retention members, such as vanes or ribs 16, may be formed to project outwardly from body 3. For example vanes 16 may extend diagonally from outer edge 4 of arcuate lip 2 to a point on the outside of side wall 20, as shown in FIG. 1. Vanes 16 may be formed as wall members preferably having a thickness to accommodate forces imposed thereon when the sprinkler shield 1 is embedded in the soil. The vanes 16 may be formed as triangular shaped fins and facilitate retention of body 3 in a predetermined position. When body 3 is embedded in soil, the soil on either side of vanes 16 will substantially prevent sprinkler shield 1 from rotating or twisting. Preferably, a plurality of vanes 16 are placed at predetermined distances from each other under lip 2, with the embodiment shown in FIG. 6 having four vanes equally spaced ninety degrees apart. It is also contemplated that a greater or lesser number of vanes 16 could be used and their length could be varied depending upon the amount of resistance desired. Other forms of retention members are also contemplated.

Referring again to FIG. 5, sprinkler shield 1 is embedded in soil 5 with outer edge 4 of lip 2 flush with the soil 5. Disposed within sprinkler shield 1 is a typical pop-up sprinkler head 40 coupled to water supply connector 44. A typical sprinkler head 40 may have a variable length male connector nipple 42 extending from the base of sprinkler head 40. Male connector nipple 42 may be threaded and cooperates with a standard threaded female connection 26 formed within base 22, so as to be coupled therewith. Although the typical sprinkler head provides an aperture for a standard threaded coupling, other coupling mechanisms are contemplated for connection 26. Water supply connector 44 also may have a male threaded extension which couples to the other side of threaded connector 26 of base 22, or another coupling may be used.

Figure 2:
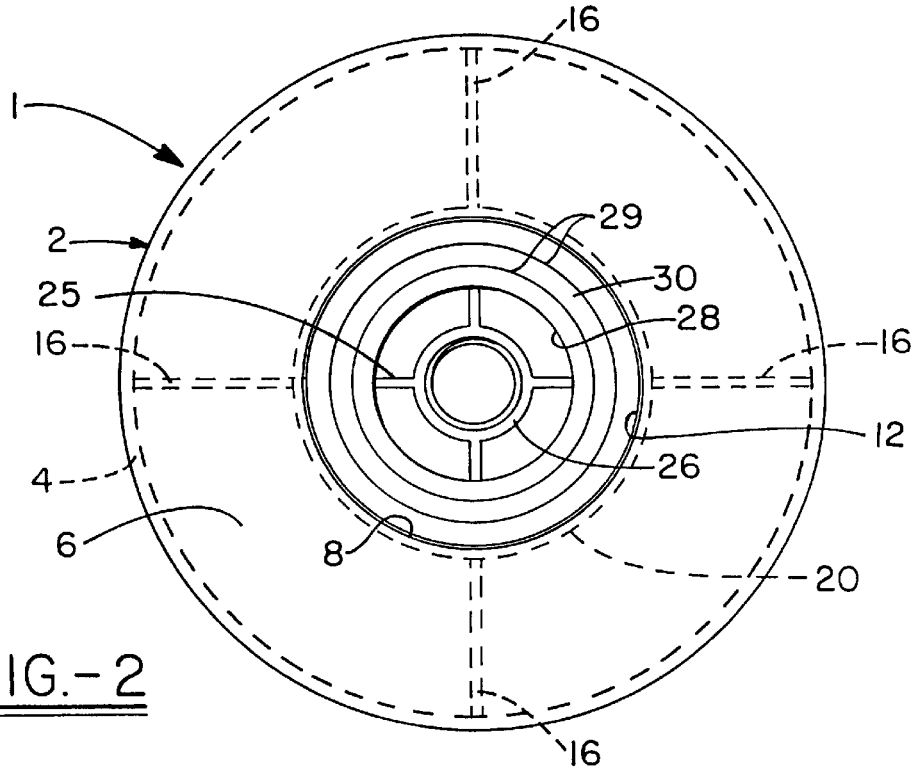
FIG. 2 is a top plan view of the improved shield.

An important object of the invention is achieved by providing the sprinkler shield 1 with a mechanism for coupling directly to a sprinkler head 40, to become the interface between sprinkler head 40 and the sprinkler system water supply 46. In the preferred embodiment, the threaded connector 26 allows sprinkler head 40 and male connector nipple 42 to be coupled in communication with the water supply line 46 via connector 44. The interface between the sprinkler head 40 and water supply line 46 provided by sprinkler shield 1 is particularly advantageous in simplifying(, maintenance and repair operations. For example, if sprinkler head 40 becomes defective for whatever reason, it can be replaced easily by simply disconnecting it from sprinkler shield 1 without having to dig up the soil which covers the water supply lines 46 and water supply connector 44. This will substantially eliminate the possibility that the water supply line 46 will become contaminated from dirt or debris. Eliminating the need to dig up the water supply line 46 will also maintain the aesthetic look of a manicured lawn and saves an enormous amount of time which otherwise would be needed to replace a defective sprinkler head 40. In the preferred embodiment, the connector 26 may extend above and below the bottom of body 3 as shown in FIG. 1. The connector 26 can be rigidified or made more structurally sound by means of internal support ribs 25 as shown in FIGS. 1, 2, and 5. Similarly, outer support ribs 27 may also be provided, which in addition to supporting connector 26, provide additional vanes which will act to inhibit rotation or twisting of the sprinkler shield 1 similarly to vanes 16.

To further support and protect sprinkler head 40, a head support member, such as a retention disc 30 is preferably provided. Referring to FIG. 1, retention disc 30 is shown disposed within recess or cavity 18 of body 3 of sprinkler shield 1 at a point toward the top of the opening therein. To provide support for the retention disc 30, there may be formed within body 3 along side wall 20 a ledge or outwardly extending seam 12, on which disc 30 can rest. The seam 12 may be formed where side wall 20 and inner-edge 8 of lip 2 meet for example, to be positioned substantially at ground level when sprinkler shield 1 is embedded in the ground. Support 12 extends outward from the inside of side wall 20, preventing retention disc 30 from slipping too far within body 3. Although only one support ledge or seam 12 is shown, a plurality of support seams 12 may be provided to support various sizes of retention discs 30 at different heights within body 3. Disposed in retention disc 30 is support aperture 28 which is preferably of a shape and size to snugly surround and support sprinkler head 40, such as a standard pop-up type. Providing sprinkler head 40 with lateral support within cavity 18 of body 3. Preferably, such lateral support is provided at a position toward the upper portion of the sprinkler head 40, FIG. 2 is a top plan view of sprinkler shield 1 and shows upstanding lip 2 which is defined by outer edge 4 and inner edge 8. It is also contemplated that to provide lateral support to a sprinkler head 40 when positioned in the sprinkler shield 1, other means such as ribs could extend inwardly from the side walls of the cavity 18.

Figure 3:
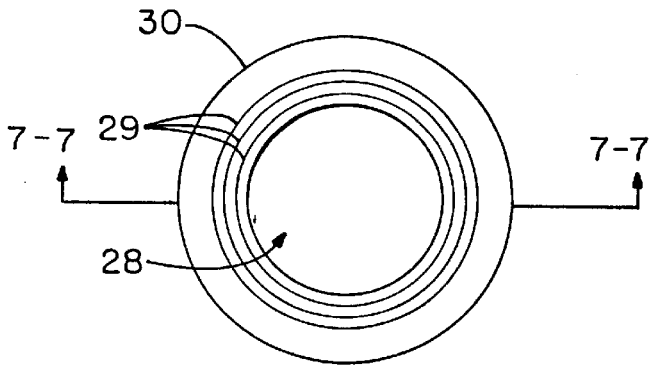
FIG. 3 is a top plan view of a preferred embodiment of the retention disc showing the smallest opening for accommodating a sprinkler head.
Figure 4:
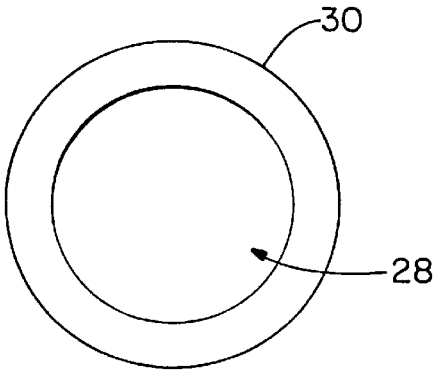
FIG. 4 is a top plan view of tile retention disc shown in FIG. 3, showing the largest opening for accommodating a sprinkler head.
Figure 7:
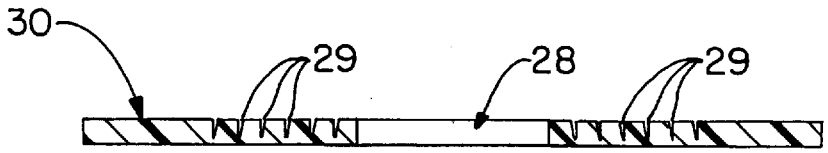
FIG. 7 is an enlarged cross-sectional view of the retention disc shown in FIG. 3 taken along line 7—7.

In the preferred embodiment, the retention disc 30 will allow various sprinkler head configurations to be accommodated. This can be accomplished by forming the retention disc 30 with a variable sized aperture 28. The variable sized aperture 28 may be formed by providing a plurality of pop out or cut out sections in disc 30, such as by forming grooves or weakened areas 29 in the disc 30 which are more distinctly shown in FIG. 7. The grooves 29 split the disc into sections which can easily be removed by popping, out or cutting the disc at these locations. FIGS. 3 and 4 show the variable sizes of the aperture 28 obtained by means of the pop out or cut out sections formed by grooves 29. In FIG. 3, the smallest aperture 28 provided in retention disc 30 is shown, where none of the pop out sections of the disc 30 have been removed. The size of the smallest aperture may correspond to the smallest size of a typical type sprinkler head 40. In FIG. 4, all of the pop out sections formed by grooves 29 have been removed from disc 30 to provide the largest aperture therein. Again, the aperture is preferably sized to correspond to the largest size of a typical type sprinkler head 40. It should be recognized that other intermediate sizes can be obtained by removing) one or more of the pop out sections up to the maximum sized aperture. Other mechanisms to provide a variable sized aperture are contemplated, or separate discs 30 having different sized apertures 28 may be provided to allow the use of any type of sprinkler head 40. This allows different sized sprinkler heads to be used by simply selecting the proper aperture size or retention disc 30. It should also be recognized that although a circular aperture 28 is shown in the preferred embodiment, corresponding to a sprinkler head 40 having a cylindrical body, any other configuration is contemplated in the invention. It is also a feature of providing the retention disc 30 with a properly sized aperture 28 that a sprinkler head 40 can be inserted through the aperture 28 of retention disc 30 so as to be aligned with the threaded coupling, 26 or other connection of the sprinkler shield 1, to facilitate assembly of the sprinkler head therewith. There may also be provided means to inhibit movement of retention disc 30 from a desired position on support ledge 12 such as upward movement thereof Although the invention has been described with reference to a preferred embodiment thereof, it should be recognized that various modifications would occur to those skilled in the art, and such modifications are contemplated by the invention. Therefore, the scope of the invention is only to be limited by the appended claims.

What is claimed is:

1. A sprinkler shield for protecting a sprinkler head comprising: a base;

at least one sidewall extending from said base defining a body, said body having a recess formed therein;

a lip extending outwardly from the top of said body;

a sprinkler head support member positioned within said recess which functions only to support a sprinkler head therein, and an aperture disposed within said base of said body.

2. A sprinkler shield as recited in claim 1, further comprising:

at least one retention member extending outwardly from said body, wherein said at least one retention member facilitates retention of said body in a predetermined position when said body is embedded within the ground.

3. A sprinkler shield as recited in claim 2, wherein;

said at least one retention member comprises a plurality of retaining members provided in spaced apart relationship around the periphery of said body.

4. A sprinkler shield as recited in claim 2, wherein said at least one retention member comprises a vane which extends downward from said outer edge of said lip to the outside of said at least one side wall.

5. A sprinkler shield as recited in claim 1, wherein said sprinkler head support member has an aperture for receiving and supporting a sprinkler head positioned within said recess of said body.

6. A sprinkler shield as recited claim 5, wherein said sprinkler head support member is seated upon a support structure extending outwardly from said at least one side wall.

7. A sprinkler shield as recited in claim 5, wherein said sprinkler head support member is separable from said recess.

8. A sprinkler shield as recited in claim 5, wherein said sprinkler head support member has a variable sized aperture.

9. A sprinkler shield as recited in claim 8, wherein said sprinkler head support member has a plurality of selectively removable sections to vary the size of said aperture.

10. A sprinkler shield as recited in claim 5, wherein said aperture of said sprinkler head support member is configured to receive a sprinkler head therethrough, and is aligned with said aperture of said base.

11. A sprinkler shield as recited in claim 1, wherein said aperture within said base of said body is threaded forming a female connector.

12. A sprinkler shield as recited in claim 1, wherein said lip extends upwardly and outwardly from the top of said at least one side wall of said body, thereby forming a soil retention cavity beneath said lip.

13. A sprinkler shield as recited in claim 1, wherein said sprinkler shield is molded from a moldable material.

14. A sprinkler shield as recited in claim 1, wherein said base, said at least one sidewall and said lip arc molded as one continuous element.

15. A sprinkler shield as recited in claim 1, wherein said aperture in said base includes at least one threaded connector to allow connection to a sprinkler head and a water supply.

16. A sprinkler shield for protecting a sprinkler head comprising;

a body member having a base and at least one sidewall defining a recess into which a sprinkler head is positioned so as to be completely enclosed by said recess;

said base having a connector to allow connection to said sprinkler head;

said body member further including at its upper end a lip which extends upwardly and outwardly from said body member, said lip having a bottom which is positioned on a support surface so as to extend upwardly from said support surface around the periphery of said body member and recess formed thereby, and a sprinkler head support member positioned within said recess.

17. A sprinkler shield as in claim 16, wherein said lip forms a retention cavity adjacent said support surface to facilitate positioning and maintaining said body member in a predetermined position relative to said support surface.

18. A sprinkler shield as in claim 16, wherein said sprinkler head support member has an aperture for receiving and supporting a sprinkler head position within said recess of said body.

19. A sprinkler shield as in claim 16, wherein said sprinkler head support member has a variable sized aperture therein for receiving and supporting a sprinkler head positioned within said recess of said body.

20. A sprinkler shield as in claim 16, further comprising at least one retention member associated with said body which facilitates retention of said body in a predetermined position when said body is embedded within the ground.

* * * * *